US011298969B1

(12) United States Patent
Frederick, III

(10) Patent No.: US 11,298,969 B1
(45) Date of Patent: Apr. 12, 2022

(54) MARKING DEVICE HOLDER

(71) Applicant: Howard Frederick, III, Crestline, CA (US)

(72) Inventor: Howard Frederick, III, Crestline, CA (US)

( * ) Notice: Subject to any disclaimer, the term of this patent is extended or adjusted under 35 U.S.C. 154(b) by 0 days.

(21) Appl. No.: 17/010,964

(22) Filed: Sep. 3, 2020

(51) Int. Cl.
*B43L 7/04* (2006.01)
*B43L 7/00* (2006.01)
*B25H 7/04* (2006.01)

(52) U.S. Cl.
CPC ..... *B43L 7/04* (2013.01); *B25H 7/04* (2013.01); *B43L 7/007* (2013.01)

(58) Field of Classification Search
CPC ..... B43L 7/04; B43L 7/007; B25H 7/04
USPC ..... 33/18.1, 449, 32.1, 32.2
See application file for complete search history.

(56) References Cited

U.S. PATENT DOCUMENTS 724,687 A * 4/1903 Floren ..... B43K 23/004 401/48
750,221 A * 1/1904 Reis ..... B25H 7/04 33/42
1,629,143 A 5/1927 Bungart
2,543,009 A * 2/1951 Frost ..... B43L 15/00 33/26
3,103,070 A 9/1963 Looker
3,266,157 A * 8/1966 De Mathe ..... B43L 7/04 33/449
4,656,744 A 4/1987 Decker
4,680,864 A * 7/1987 Heagerty ..... B43L 9/00 33/26
4,794,699 A * 1/1989 Perna ..... B25H 7/04 33/27.03
5,309,643 A * 5/1994 McCollom ..... B26B 29/06 15/437
5,915,806 A * 6/1999 Levee ..... B25F 1/00 33/42
6,941,672 B2 9/2005 Scarborough
7,040,035 B1 5/2006 Scarborough
7,818,888 B2 10/2010 Bahler
7,905,025 B1 * 3/2011 Andersen ..... B25H 7/045 33/38
8,028,426 B1 * 10/2011 Totani ..... B43K 23/001 33/41.4
8,684,243 B1 * 4/2014 Baumann ..... B62K 3/002 224/422
8,806,766 B1 * 8/2014 Lee ..... B43L 9/007 33/27.04
9,308,771 B2 * 4/2016 Ghorbanloo ..... B43L 9/04
9,457,612 B2 10/2016 Ghorbanloo
(Continued)

*Primary Examiner* — Yaritza Guadalupe-McCall
(74) *Attorney, Agent, or Firm* — Cramer Patent & Design, PLLC; Aaron R. Cramer

(57) ABSTRACT

The marking device holder may comprise a body, an instrument holder, and a plurality of touch points. The marking device holder may be operable to move a writing instrument over a writing surface in a straight line. The writing instrument may detachably couple to the instrument holder such that the writing instrument contacts the writing surface. The plurality of touch points may form a stable base for the body that may resist tipping and may reduce friction during forward motion of the body. As non-limiting examples, the writing instrument may be a pen, a pencil, a mechanical pencil, a marker, or a stylus. As non-limiting examples, the writing surface may be paper or a device screen.

18 Claims, 4 Drawing Sheets

(56) References Cited

U.S. PATENT DOCUMENTS

| | | | | |
|---|---|---|---|---|
| 10,179,403 | B1 * | 1/2019 | Mikhaylenko | B25H 7/04 |
| 2004/0226180 | A1 * | 11/2004 | Solum | B43L 9/02 33/27.02 |
| 2010/0031519 | A1 * | 2/2010 | Guiney | G02B 21/34 33/27.01 |
| 2013/0042488 | A1 * | 2/2013 | Kraljevic | B43L 13/007 33/27.12 |
| 2016/0023502 | A1 * | 1/2016 | Ghorbanloo | B43L 9/005 33/27.03 |
| 2016/0185153 | A1 * | 6/2016 | Ghorbanloo | B43L 9/005 33/27.03 |

* cited by examiner

MARKING DEVICE HOLDER

RELATED APPLICATIONS

Non-applicable.

FIELD OF THE INVENTION

The present invention relates to a device holder and more specifically to a marking device holder.

BACKGROUND OF THE INVENTION

Even with the proliferation of electronic devices and systems such as computers, smart phones, tablet computers, email, voice mail, and the like, a great deal of business is still conducted by paper and pen. After writing, one of the most common tasks performed by a pen or pencil is producing a straight line, such as when forming a table or graph, outlining or boxing in a section of text, or producing a graphical image such as in a sketch, while drafting, or even producing artwork.

While in an office setting, a ruler a straight edge is usually available to help with such a task, however when in the field or when working in a mobile environment, as many of us do in today's world, such straightedges are often not available. This forces to user to draw straight lines in a freehand manner usually with less than satisfactory results. Accordingly, there exists a need for a means by which straight lines can be drawn with a pen or pencil almost anywhere in a manner which addresses the above constraints. The development of the marking device holder fulfills this need.

SUMMARY OF THE INVENTION

The principles of the present invention provide for a straight-line pen holder has a body having a left armature, a right armature, a front cross brace, a rear cross brace, and one or more instrument support struts. The left armature and the right armature include a supporting frame for the writing instrument and the touch points. The straight-line pen holder also has an instrument holder which supports the writing instrument in an upright orientation such that the writing instrument touches the writing surface as the straight-line pen holder is moved over the writing surface. The straight-line pen holder also has a plurality of touch points forming a stable base for the body that resists tipping and reduces friction during forward motion of the body. The touch points include a pair of rear touch points and the front touch point, each of the touch points are a point of contact between the straight line pen holder and the writing surface.

The left armature and the right armature may be coupled via the front cross brace at the front of the body and via the rear cross brace at the rear of the body. The front cross brace and the rear cross brace may be oriented laterally across the body. The front cross brace may be shorter than the rear cross brace when the body has the shape of an isosceles triangle when viewed from above. The body may include a center cross brace that may be laterally oriented and may couple the left armature to the right armature at a midpoint of the body. The left armature and the right armature bow upwards in the middle to provide an improved sight-line from a user to a tip of the writing instrument. The instrument holder may be cylindrical and hollow. A bore may pass longitudinally through the instrument holder from an upper aperture at the top of the instrument holder to a lower aperture at the bottom of the instrument holder.

A spring may be fixedly attached to an interior of the bore and the writing instrument is inserted into the top of the instrument holder via the upper aperture and may pass through the spring of the bore of the instrument holder and exits at the bottom of the instrument holder via the lower aperture. The spring may be compressed by the outer surface of writing instrument to enable the writing instrument to extend downward through the bore and enable contact of the tip with the writing surface. The outer wall of the instrument holder and the bore inside of the instrument holder may be tapered and are narrowed from top to bottom to accommodate the diameter of the writing instrument to more securely seat the writing instrument in the instrument holder.

The straight-line pen holder may further comprise a front touch point which may be coupled to the front cross brace at a front and center of the body and a pair of rear touch points which may be coupled to the rear cross brace at the rear of the body. The pair of rear touch points may include a left rear touch point and a right rear touch point. The pair of rear touch points may be separated such that the straight line drawn by the writing instrument may not be defaced by the passage of the straight-line pen holder. The pair of rear touch points may reduce friction between the body and the writing surface during forward motion of the body. The straight-line pen holder may move the writing instrument over the writing surface in the straight line.

The writing instrument may detachably couple to the instrument holder such that the writing instrument contacts the writing surface. The writing instrument may be a device selected from the group consisting of a pen, a pencil, a mechanical pencil, a marker, or a stylus. The writing surface may be a piece of paper. The writing surface may be a device screen.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
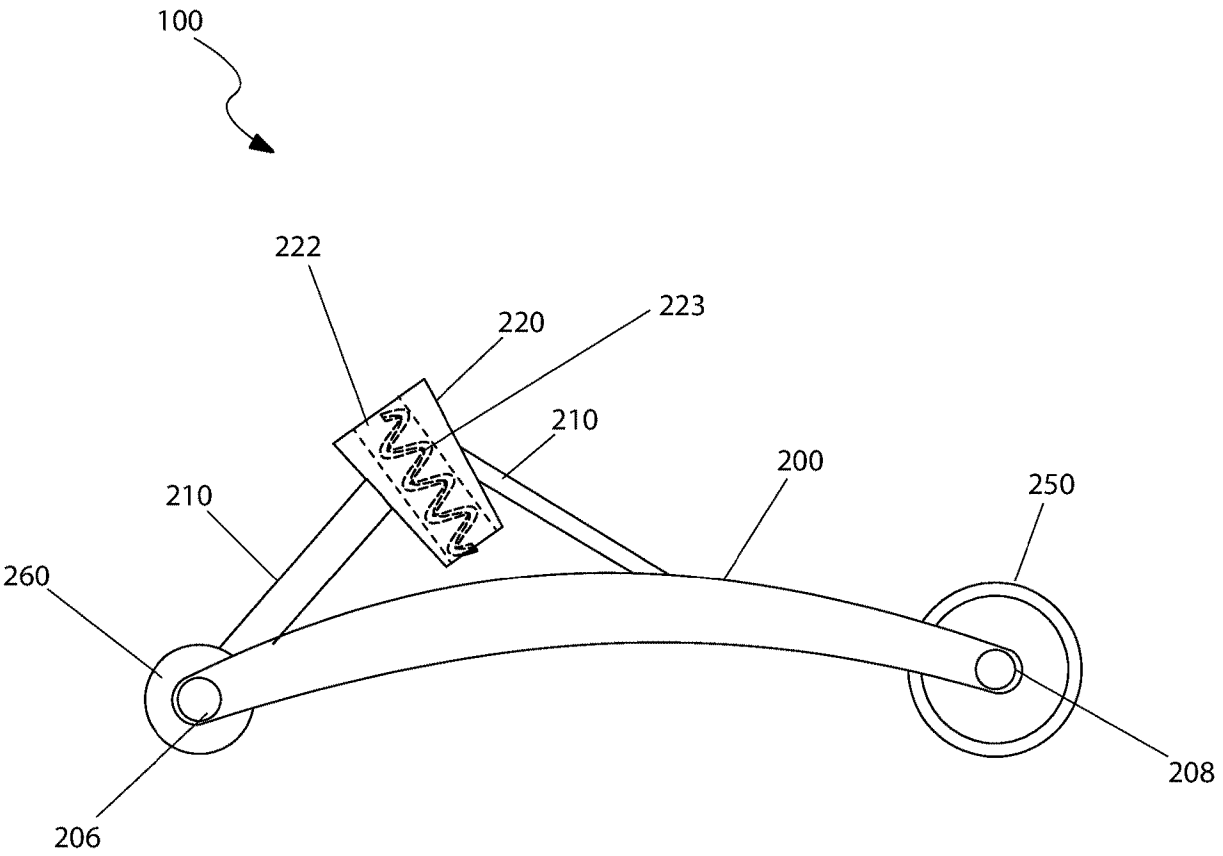
FIG. 1 is a side view of a straight line pen holder, according to an embodiment of the present invention.

100 straight line pen holder
200 body
202 left armature
204 right armature
206 front cross brace
208 rear cross brace
210 instrument support strut
212 center cross brace
220 instrument holder
222 bore
223 spring
224 upper aperture
226 lower aperture

228 instrument tilt angle
250 pair of rear touch points
252 left rear touch point
254 right rear touch point
260 front touch point
900 writing instrument
902 tip
920 writing surface
930 straight line

DESCRIPTION OF THE INVENTION

The present invention is directed to a straight line pen holder (herein described as the "invention") 100. The invention 100 may comprise a body 200, an instrument holder 220, and a plurality of touch points. The invention 100 may be operable to move a writing instrument 900 over a writing surface 920 in a straight line 930. The writing instrument 900 may detachably couple to the instrument holder 220 such that the writing instrument 900 contacts the writing surface 920. The plurality of touch points may form a stable base for the body 200 that may resist tipping and may reduce friction during forward motion of the body 200. As non-limiting examples, the writing instrument 900 may be a pen, a pencil, a mechanical pencil, a marker, or a stylus. As non-limiting examples, the writing surface 920 may be paper or a device screen.

The body 200 may comprise a left armature 202, a right armature 204, a front cross brace 206, a rear cross brace 208, and one (1) or more instrument support struts 210. The left armature 202 and the right armature 204 may comprise a supporting frame for the writing instrument 900 and the plurality of touch points. The left armature 202 and the right armature 204 may be coupled via the front cross brace 206 at the front of the body 200 and via the rear cross brace 208 at the rear of the body 200. The front cross brace 206 and the rear cross brace 208 may be oriented laterally across the body 200. The front cross brace 206 may be shorter than the rear cross brace 208 such that the body 200 has the shape of an isosceles triangle when viewed from above.

In some embodiments, the body 200 may further comprise a center cross brace 212 that is laterally oriented and coupled the left armature 202 to the right armature 204 at a midpoint of the body 200.

In some embodiments, the left armature 202 and the right armature 204 may be adapted to bow upwards in the middle to provide an improved sight-line from a user to a tip 902 of the writing instrument 900. The upward bow may be apparent in FIG. 1. A front touch point 260 may be coupled to the front cross brace 206 at the front, center of the body 200. A pair of rear touch points 250 may be coupled to the rear cross brace 208 at the rear of the body 200. The instrument holder 220 may be coupled to the body 200 via the one or more instrument support struts 210.

Figure 3:
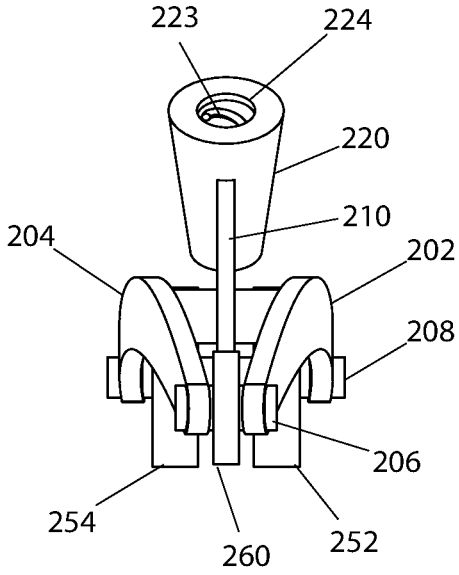
Figure 4:
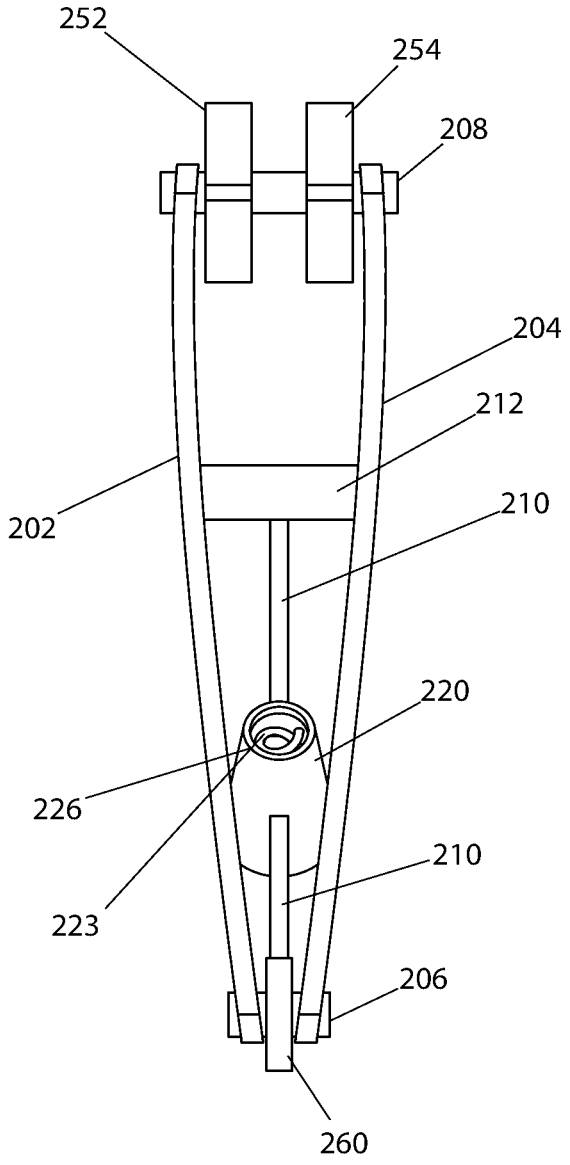

The instrument holder 220 may support the writing instrument 900 in an upright orientation such that the writing instrument 900 may touch the writing surface 920 as the invention 100 is moved over the writing surface 920. The instrument holder 220 may be cylindrical and hollow. A bore 222 may pass longitudinally through the instrument holder 220 from an upper aperture 224 at the top of the instrument holder 220 to a lower aperture 226 at the bottom of the instrument holder 220. A spring 223 is fixedly attached to an interior of the bore 222. The writing instrument 900 may be inserted into the top of the instrument holder 220 via the upper aperture 224, may pass through the spring 223 of the bore 222 of the instrument holder 220, and may exit at the bottom of the instrument holder 220 via the lower aperture 226. The upper aperture 224 may be apparent in FIG. 3. The lower aperture 226 and the triangular shape of the body 200 may be apparent in FIG. 4. In some embodiments, the outer wall of the instrument holder 220, the bore 222 inside of the instrument holder 220, or both, may be tapered—narrowing from top to bottom. Narrowing of the bore 222 may be operable to accommodate the diameter of the writing instrument 900 and/or to more securely seat the writing instrument 900 in the instrument holder 220. The spring 223 can be compressed by the outer surface of writing instrument 900 to enable the writing instrument 900 to extend downward through the bore 222 and enable contact of the tip 902 with the writing surface 920. When released, the spring 223 can enable the tip 902 of the writing instrument 900 to disengage from the writing surface 920. The instrument holder 220 may be oriented to tilt the writing instrument 900 forward at an instrument tilt angle 228 such that friction at the tip 902 of the writing instrument 900 is reduced for dragging the tip 902 across the writing surface 920.

The plurality of touch points may comprise the pair of rear touch points 250 and the front touch point 260. Each of the plurality of touch points may be a point of contact between the invention 100 and the writing surface 920. The plurality of touch points may be operable to move the invention 100 over the writing surface 920. As non-limiting examples, an individual touch point selected from the plurality of touch points may be a glide, a ski, or a wheel. As used herein, "glide" may refer to a non-rotating contact point on the invention 100 that may reduce friction where the invention 100 contacts the writing surface 920. As non-limiting examples, the glide may comprise contact surfaces made of plastic, nylon, polished metal, or felt. As used here, "ski" may refer to a narrow strip of semi-rigid material that is intended to slide longitudinally over a surface. As used herein, "wheel" may refer to a circular component that revolves around an axle. The wheel may reduce friction between the object that the wheel is mounted on and the surface that the wheel travels over. The individual touch point may be fixed such that a curved contour of the individual touch point contacts the writing surface 920 and slides over the writing surface 920.

Figure 2:
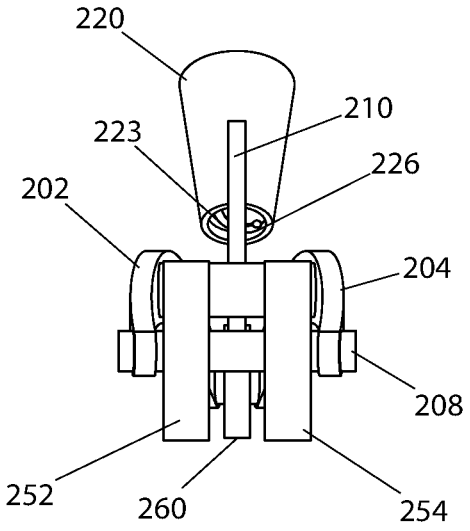
FIG. 2 is a rear view of a straight line pen holder, according to an embodiment of the present invention; and, FIG. 3 is a front view of a straight line pen holder, according to an embodiment of the present invention; and, FIG. 4 is a bottom view of a straight line pen holder, according to an embodiment of the present invention; and, FIG. 5 is an in-use view of a straight line pen holder, according to an embodiment of the present invention.

The pair of rear touch points 250 may comprise a left rear touch point 252 and a right rear touch point 254. The pair of rear touch points 250 may be separated such that the straight line 930 drawn by the writing instrument 900 is not defaced by the passage of the invention 100. The separation of the pair of rear touch points 250 may be apparent in FIG. 2. In some embodiments, the pair of rear touch points 250 may be the wheels mounted on the rear cross brace 208. The pair of rear touch points 250 may reduce friction between the body 200 and the writing surface 920 during forward motion of the body 200.

In some embodiments, the invention 100 may be operable to draw the straight line 930 on a device screen. As non-limiting example, the device screen may be a touch screen or a digitizer screen. The writing instrument 900 may be a stylus. The overall size of the body 200 and the diameter of the bore 222 may vary to best suit the writing instrument 900 and the writing surface 920. As non-limiting examples, the body 200 and the bore 222 may be larger to hold a pen drawing on paper and smaller to hold a stylus marking on a digitizer screen.

Figure 5:
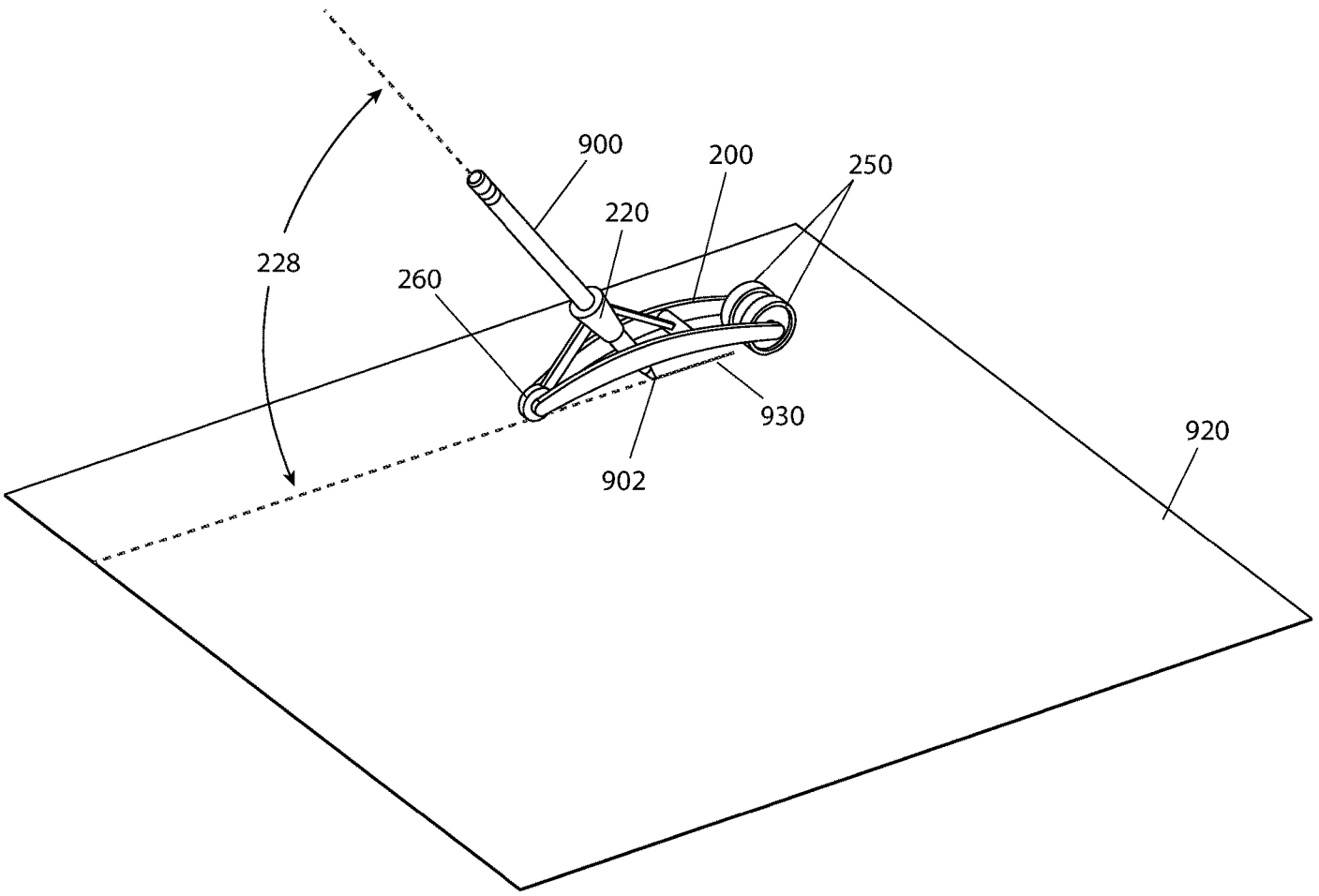

In use, a writing instrument 900 is placed into the instrument holder 220. The invention 100 may be oriented in a desired direction of travel and placed on a writing surface 920. The user may push the body 200 forward and allow the tip 902 of the writing instrument 900 to draw a straight line 930, as shown in FIG. 5. The user may remove the invention 100 from the writing surface 920 and reposition the invention 100 to draw additional straight lines 930.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A straight-line pen holder, comprising:

a body having a left armature, a right armature, a front cross brace, a rear cross brace, and one or more instrument support struts, the left armature and the right armature include a supporting frame for the writing instrument and the touch points;

an instrument holder support the writing instrument in an upright orientation such that the writing instrument touches the writing surface as the straight-line pen holder is moved over the writing surface;

a plurality of touch points forming a stable base for the body that resists tipping and reduces friction during forward motion of the body, the touch points include a pair of rear touch points and the front touch point, each of the touch points are a point of contact between the straight line pen holder and the writing surface; and, wherein the left armature and the right armature are coupled via the front cross brace at the front of the body and via the rear cross brace at the rear of the body; and, wherein the front cross brace and the rear cross brace are oriented laterally across the body.

2. The straight-line pen holder, according to claim 1, wherein the front cross brace is shorter than the rear cross brace when the body has the shape of an isosceles triangle when viewed from above.

3. The straight-line pen holder, according to claim 1, wherein the body includes a center cross brace that is laterally oriented and couples the left armature to the right armature at a midpoint of the body.

4. The straight-line pen holder, according to claim 1, wherein the left armature and the right armature bow upwards in the middle to provide an improved sight-line from a user to a tip of the writing instrument.

5. The straight-line pen holder, according to claim 1, wherein the instrument holder is cylindrical and hollow.

6. The straight-line pen holder, according to claim 1, wherein a bore passes longitudinally through the instrument holder from an upper aperture at the top of the instrument holder to a lower aperture at the bottom of the instrument holder.

7. The straight line pen holder, according to claim 6, wherein a spring is fixedly attached to an interior of the bore and the writing instrument is inserted into the top of the instrument holder via the upper aperture and passes through the spring of the bore of the instrument holder and exits at the bottom of the instrument holder via the lower aperture.

8. The straight-line pen holder, according to claim 7, wherein the spring is compressed by the outer surface of writing instrument to enable the writing instrument to extend downward through the bore and enable contact of the tip with the writing surface.

9. The straight-line pen holder, according to claim 1, wherein the outer wall of the instrument holder and the bore inside of the instrument holder are tapered and are narrowed from top to bottom to accommodate the diameter of the writing instrument to more securely seat the writing instrument in the instrument holder.

10. The straight-line pen holder, according to claim 1, further comprising a front touch point is coupled to the front cross brace at a front and center of the body and a pair of rear touch points are coupled to the rear cross brace at the rear of the body.

11. The straight-line pen holder, according to claim 10, wherein the pair of rear touch points include a left rear touch point and a right rear touch point.

12. The straight-line pen holder, according to claim 10, wherein the pair of rear touch points are separated such that the straight line drawn by the writing instrument is not defaced by the passage of the straight-line pen holder.

13. The straight-line pen holder, according to claim 10, wherein the pair of rear touch points reduce friction between the body and the writing surface during forward motion of the body.

14. The straight-line pen holder, according to claim 1, wherein the straight-line pen holder moves the writing instrument over the writing surface in the straight line.

15. The straight-line pen holder, according to claim 1, wherein the writing instrument detachably couples to the instrument holder such that the writing instrument contacts the writing surface.

16. The straight-line pen holder, according to claim 1, wherein the writing instrument is a device selected from the group consisting of a pen, a pencil, a mechanical pencil, a marker, or a stylus.

17. The straight-line pen holder, according to claim 1, wherein the writing surface is a piece of paper.

18. The straight-line pen holder, according to claim 1, wherein the writing surface is a device screen.

* * * * *